US005392925A

United States Patent [19]

Seyffert

[11] Patent Number: 5,392,925

[45] Date of Patent: Feb. 28, 1995

[54] SHALE SHAKER AND SCREEN

[75] Inventor: Kenneth W. Seyffert, Houston, Tex.

[73] Assignee: Environmental Procedures, Inc., Houston, Tex.

[21] Appl. No.: 105,696

[22] Filed: Aug. 12, 1993

[51] Int. Cl.[6] ..... B07B 1/49

[52] U.S. Cl. ..... 209/405; 209/403

[58] Field of Search ..... 209/399, 405, 403, 395, 209/408, 404, 402, 413, 313

[56] References Cited

U.S. PATENT DOCUMENTS

| | | | |
|---|---|---|---|
| 275,340 | 4/1883 | Kimball | 209/403 |
| 516,673 | 3/1894 | Wilson | 209/413 |
| 777,317 | 12/1904 | Traylor | 210/384 |
| 964,897 | 7/1910 | Bryant | 210/155 |
| 1,073,825 | 9/1913 | Spring | 209/403 |
| 1,132,667 | 3/1915 | Milliot | 209/403 |
| 1,242,982 | 10/1917 | Reynolds | 209/405 |
| 1,248,081 | 11/1917 | Couch | 210/155 |

(List continued on next page.)

FOREIGN PATENT DOCUMENTS

| | | |
|---|---|---|
| 0169698 | 7/1985 | European Pat. Off. . |
| 743902 | 1/1956 | United Kingdom . |
| 957193 | 5/1964 | United Kingdom . |
| 2161715A | 6/1984 | United Kingdom . |
| 2162091B | 7/1984 | United Kingdom . |
| 2161715B | 9/1984 | United Kingdom . |
| 2175222 | 4/1985 | United Kingdom . |

OTHER PUBLICATIONS

"McNally Coal Preparation Manual, M 576" pp. iii, 73–96,216 (1978).

"Layered shale shaker screens improve mud solids control," World Oil (1978).

"The Brandt Company General Catalog 1982–83," 4 pages (1982).

"Derrick Sandwich Shaker," Derrick Equipment Co. (Prior to 1992).

"Solids Control Equipment," Derrick Equipment Co. (Prior to 1992).

"The Derrick sandwich shaker," Derrick Manufacturing Corporation (Prior to 1992).

"Take The Drilled Solids Out," The Brandt Company, (Sep. 1980).

"Sweco Full-Flow," Sweco, Inc., 1992.

"Sweco Oilfield Services," Composite Catalog, 1992.

"Supertaut Mud Cleaner Screens," Sweco Oilfield Serivces, 1992.

"LM-3 Full-Flo Shale Shaker," Sweco Oilfield Services, 1991.

"Clean Liquids/Dry Solids," Flo Trend Systems, Inc., 1989.

"Filtration & Separation," Flo Trend Systems, Inc. 1989.

*Primary Examiner*—Kenneth W. Noland

*Attorney, Agent, or Firm*—Guy McClung

[57] ABSTRACT

A vibratable shale shaker screen is disclosed which, in one aspect, has a frame, screening material secured over the frame, and one or more sealing members secured to the frame for sealingly contacting an adjacent frame and/or adjacent portions of the frame or of screen mounting apparatus such as mount channels on the frame. Alternatively, sealing elements are provided on screen mounting apparatus, e.g. channels, on a shale shaker. A shale shaker is disclosed with at least one such screen. In one aspect such a shale shaker has three such screens disposed in a tiered configuration, one screen in sealing contact with the next. Adjustable screen mounts are disclosed for releasably holding the screens in sealing contact with each other and with screen mounting apparatus.

11 Claims, 9 Drawing Sheets

U.S. PATENT DOCUMENTS

| | | | |
|---|---|---|---|
| 1,397,339 | 11/1921 | Sturtevant | 209/319 |
| 1,423,021 | 7/1922 | Reynolds | 209/399 |
| 1,626,774 | 5/1927 | Allan | 210/388 |
| 1,713,143 | 5/1929 | Overstrom | 209/399 |
| 1,716,758 | 6/1929 | Bland . | |
| 1,879,377 | 9/1932 | McNeely | 209/403 |
| 1,997,713 | 4/1935 | Boehm | 209/393 |
| 2,061,850 | 11/1936 | Roberts | 210/76 |
| 2,089,548 | 8/1937 | Frantz et al. | 210/149 |
| 2,104,785 | 1/1938 | Akeyson | 210/384 |
| 2,235,653 | 3/1941 | Soldan | 209/395 |
| 2,251,909 | 8/1941 | Lindsay | 210/149 |
| 2,274,700 | 3/1942 | Jenks | 209/401 |
| 2,335,084 | 11/1943 | Rice | 209/408 |
| 2,408,558 | 10/1946 | Hutchison | 209/269 X |
| 2,462,878 | 3/1949 | Logue | 210/149 |
| 2,480,320 | 8/1949 | Carrier | 210/388 |
| 2,511,239 | 6/1950 | Behnke et al. | 209/403 |
| 2,643,586 | 6/1953 | Colvin | 209/254 |
| 2,648,441 | 8/1953 | Soldan | 210/155 |
| 2,667,975 | 2/1954 | Seaholm | 210/152 |
| 2,670,079 | 2/1954 | Betts | 209/405 |
| 2,677,462 | 5/1954 | Conkling | 209/403 |
| 2,723,032 | 11/1955 | Gisler et al. | 209/401 |
| 2,774,477 | 12/1956 | Pollitz | 209/403 |
| 2,813,629 | 11/1957 | Brugmann | 209/403 |
| 2,902,165 | 9/1959 | Imershein | 210/486 |
| 2,985,303 | 5/1961 | Wright | 209/405 |
| 3,070,231 | 12/1962 | McCorkel et al. | 209/319 |
| 3,092,573 | 6/1963 | Lambert et al. | 209/403 |
| 3,176,843 | 4/1965 | Hoskins et al. | 209/403 |
| 3,195,729 | 7/1965 | Kracklauer et al. | 210/388 |
| 3,255,885 | 6/1966 | Burls | 209/269 |
| 3,477,574 | 11/1969 | Malfroy | 209/403 |
| 3,489,679 | 1/1970 | Davidson et al. | 210/19 |
| 3,513,090 | 5/1970 | Migule et al. | 210/19 |
| 3,616,906 | 11/1971 | Miller et al. | 209/403 |
| 3,642,133 | 2/1972 | Venanzetti | 209/314 |
| 3,666,095 | 5/1972 | Krynock et al. | 209/254 |
| 3,833,123 | 9/1974 | Walker | 210/241 |
| 3,900,628 | 8/1975 | Stewart | 428/134 |
| 4,033,865 | 7/1977 | Derrick, Jr. | 209/275 |
| 4,040,951 | 7/1977 | Cole | 209/408 |
| 4,082,657 | 4/1978 | Gage | 209/311 |
| 4,140,630 | 2/1979 | Scarlett et al. | 209/313 |
| 4,248,701 | 2/1981 | Wenzel | 209/363 |
| 4,350,591 | 9/1982 | Lee | 210/384 |
| 4,380,494 | 4/1983 | Wilson | 209/319 |
| 4,420,391 | 12/1983 | Sharki | 209/403 |
| 4,457,839 | 7/1984 | Bailey | 210/314 |
| 4,529,510 | 7/1985 | Johnson et al. | 209/403 |
| 4,546,783 | 10/1985 | Lott | 134/109 |
| 4,575,421 | 3/1986 | Derrick et al. | 209/397 |
| 4,582,597 | 4/1986 | Huber | 204/313 |
| 4,634,535 | 1/1987 | Lott | 210/780 |
| 4,655,907 | 4/1987 | Ando | 209/404 |
| 4,728,422 | 3/1988 | Bailey | 210/314 |
| 4,735,712 | 4/1988 | Herren et al. | 209/403 |
| 4,820,407 | 4/1989 | Lilie | 209/397 |
| 4,840,728 | 6/1989 | Connolly et al. | 209/405 |
| 4,882,054 | 11/1989 | Derrick et al. | 210/389 |
| 5,037,536 | 8/1991 | Koch et al. | 209/325 |
| 5,076,921 | 12/1991 | Bailey et al. | 210/255 |
| 5,112,475 | 5/1992 | Henry, Jr. | 209/403 |
| 5,221,008 | 6/1993 | Derrick, Jr. et al. | 209/269 |

SHALE SHAKER AND SCREEN

BACKGROUND OF THE INVENTION

1. Field Of The Invention

The present invention is directed to vibratory sealing screens, to filtering screens, to devices with vibrating screens, to shale shakers with vibrating screens, to shale shakers with sealed tiered screens, and to methods and devices for mounting one or more screens in a shale shaker.

2. Description of Related Art

The prior art discloses a wide variety of vibrating screens, devices which use them, shale shakers, and screens for shale shakers. In shale shakers which use a plurality of screens, problems are encountered with the leakage of fluid, e.g. mud, between screens and between screens and the edges of screen supporting members. Mud which leaks through these areas is not screened; i.e. an acceptable level of the separation of liquid (e.g. oil) from cuttings or drilling solids is not achieved.

The need for solids control in drilling mud in hydrocarbon well drilling is well known in the prior art. Drilling mud, typically a mixture of clay and water and various additives, is pumped through a hollow drill string (pipe, drill collar, bit, etc.) down into a well and exits through holes in a drillbit. The mud picks up cuttings (rock bits) and other solids from the well and carries them upwardly away from the bit and out of the well in a space between the well walls and the drill string. At the top of the well, the solids-laden mud is introduced to a shale shaker, a device which typically has a series of screens arranged in tiered or flat disposition with respect to each other. The screens catch and remove solids from the mud as the mud passes through them. If drilled solids are not removed from the mud used during the drilling operation, recirculation of the drilled solids can create viscosity and gel problems in the mud, as well as increasing wear in mud pumps and other mechanical equipment used for drilling. In some shale shakers a fine screen cloth is used with the vibrating screen. The screen may have two or more overlying layers of screen cloth. The frame of the vibrating screen is resiliently suspended or mounted upon a support and is caused to vibrate by a vibrating mechanism, e.g. an unbalanced weight on a rotating shaft connected to the frame. Each screen may be vibrated by vibratory equipment to create a flow of trapped solids in either direction on top surfaces of the screen for removal and disposal of solids. The fineness or coarseness of the mesh of a screen may vary depending upon mud flow rate and the size of the solids to be removed.

Certain prior art screens have sealing members along opposed sides of the screens to seal downwardly against or upwardly against a mounting surface, e.g. a screen mounting member such as a "C" shaped channel. In other prior art devices, the screens are pressed against seals which are disposed on and/or secured to the mounting apparatus; in one device this is done on four sides of a rectangular screen. Applicant is unaware, however, of any prior art which addresses the problem of leakage at ends of channel mountings which hold screens.

SUMMARY OF THE PRESENT INVENTION

The present invention, in one embodiment includes a shale shaker with a frame; a "basket" or screen mounting apparatus; one or more screens; basket vibrating apparatus; and apparatus for sealing off flow paths between adjacent screens, flow paths through and at the ends of screen mounting channels and flow paths between screens and the screen mounting channels. Preferably, seals are effected between adjacent screen ends; between screen sides and screen side mounting channels; and seals on screens seal off fluid flow paths through the ends of the side mounting channels so that fluid cannot pass by the screens along or through the channels. In one aspect a screen is provided which has a seal strip extending along its end which is positioned to abut an adjacent screen. With respect to an end of a screen which abuts the basket (e.g. an end or a side channel or plate on the frame) a seal strip on the screen (or alternatively on the channel) seals off a screen-basket or screen-channel interface. Other sealing members are, preferably, disposed on sides of the screens to seal off various critical screen-channel interfaces, channel ends, and screen-mounting-apparatus/screen interfaces. Alternatively these side sealing members can be connected to the mounting channels or frame.

In one embodiment a screen seal strip includes an angled metal strip with a strip of rubber attached to it along its length. In another embodiment a strip of plastic is employed without any angled metal member, and preferably with a bead or raised portion along its length for contacting an adjacent member. In another embodiment, one or both ends of a screen has a seal member secured thereto for end-to-end sealing with adjacent screens or members on the same level. For tiered screens, this seal strip and/or angles member preferably projects above. The first screen surface for contacting another screen disposed adjacent but above the first screen.

Most preferably, each screen is mounted so that substantially all of its periphery is sealed in one way or another; i.e., screen ends are sealed with seal strips against other screen ends or mounting members, screen sides are sealed by being forced against side channels and/or with side seal strips on the screens or on the side channels, and areas not so forced against side channels have sealing members to seal off these areas (e.g. channel ends). Preferably seals on screens are beneath the level of screen mounting channels so that a smooth unobstructed uncluttered surface is presented to fluid material to be screened which flows over the tops of the screens.

In one aspect screens are held tightly in place and in sealing contact with screen channel mounts by adjustable wedges underneath the screens which are manipulable either to tighten screens in place or to loosen them for removal.

It is preferred in certain embodiments of screens according to this invention that both end seal strips and side seal members be removably secured to the screen frame (or alternatively to screen mounting apparatus) so that worn or damaged seals may be easily and quickly replaced. In other embodiments seal strips or side seal members are secured to or formed integrally of screen frame members permanently or semi-permanently.

It is, therefore, an object of at least certain preferred embodiments of the present invention to provide:

New, useful, unique, efficient, non-obvious screens, filtering screens, sealed screen mountings, and shale shakers with such items;

A screen for a shale shaker with one or more sealing elements secured thereto;

Adjustable screen mounting apparatus for mounting and holding the screen in a shale shaker, preferably with such apparatus beneath the screens;

A shale shaker with a plurality of screens, each sealed against adjacent screens and sealed against screen mounting apparatus of the shale shaker; and, in one particular aspect, such a shale shaker in which the screens are tiered;

A screen with removable sealing elements and a shale shaker with one or more such screens;

A shale shaker with screen mounting apparatus having screen sealing elements removably secured thereto;

A shale shaker apparatus with such screens in which an uncluttered or substantially uncluttered surface is presented to fluid such as drilling mud which is to be screened; and A shale shaker with a plurality of screens and mounting apparatus with which it is not necessary to completely remove other screens in order to remove a particular screen.

Certain embodiments of this invention are not limited to any particular individual feature disclosed here, but include combinations of them distinguished from the prior art with their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a basis or creative impetus for designing other structures, methods and systems for carrying out and practicing the present invention. The claims of this invention should be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

DESCRIPTION OF EMBODIMENTS PREFERRED AT THE TIME OF FILING FOR THIS PATENT

Figure 1:
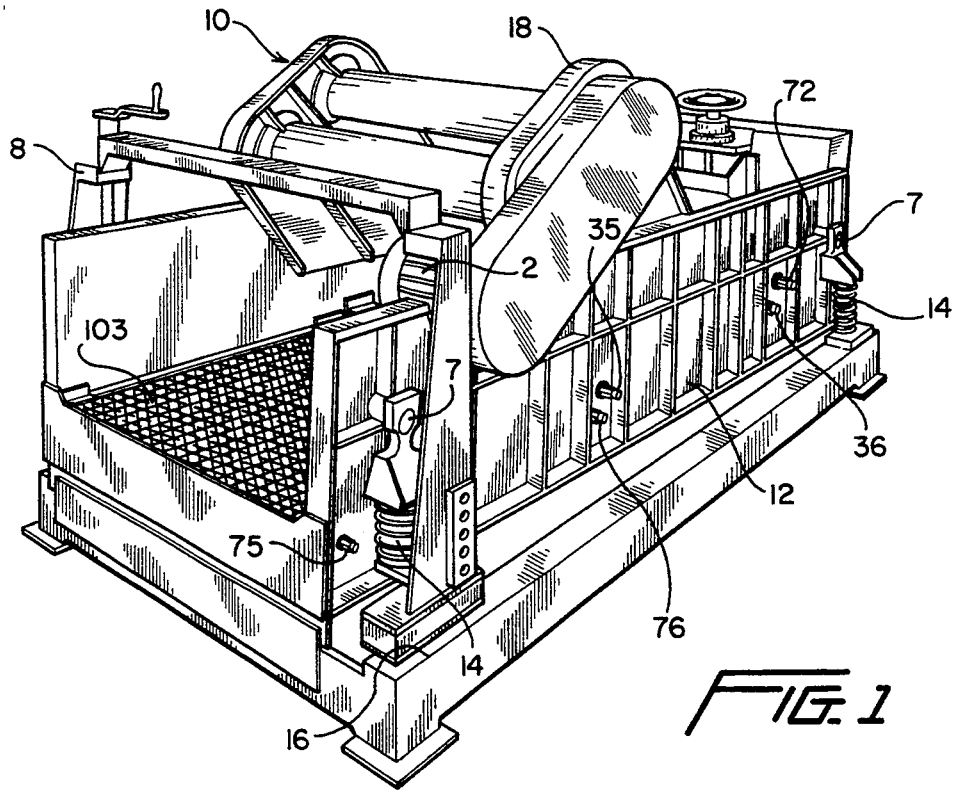
FIG. 1 is a perspective view of a shale shaker according to the present invention.
Figure 2:
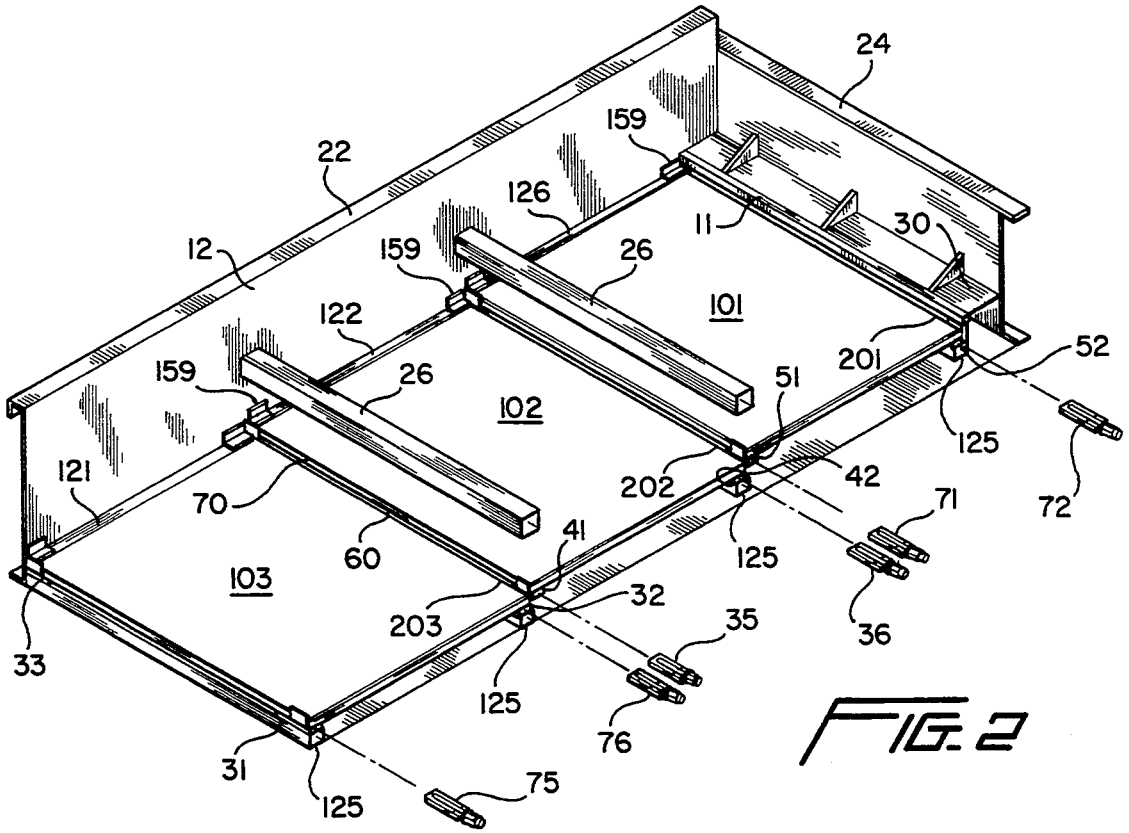
FIG. 2 is a partial perspective view partially in cross-section of the shale shaker of FIG. 1.

Referring now to FIGS. 1 and 2, a shale shaker 10 according to the present invention has three screens 101,102, 103 (each covered with screening cloths or cloths as desired) according to the present invention mounted on vibratable screen mounting apparatus or "basket" 12. The basket 12 is mounted on springs 14 (only two shown; two as shown are on the opposite side) which are supported from a frame 16. The basket 12 is vibrated by a motor 2 and interconnected vibrating apparatus 18 which is mounted on the basket 12 for vibrating the basket and the screens. Elevator apparatus 8 provides for raising and lowering of the basket end.

As shown in FIG. 2, the three screens 101, 102, 103 (shown schematically without defined screen cloth openings) disposed within tiered side mounting channel pairs are tiered with the screen 101 at a highest level and the screen 103 at a lowest level. Material to be shaken is introduced onto the first screen 101 from a deflector plate 30. A bar 11 is secured to the deflector plate 30. A seal member 201 on the first screen 101 seals the bar/-screen interface. A seal member 202 on the second screen 102 seals the screen-101/screen-102 interface. A seal 203 on the third screen 103 seals the screen-102/screen-103 interface.

Figure 3:
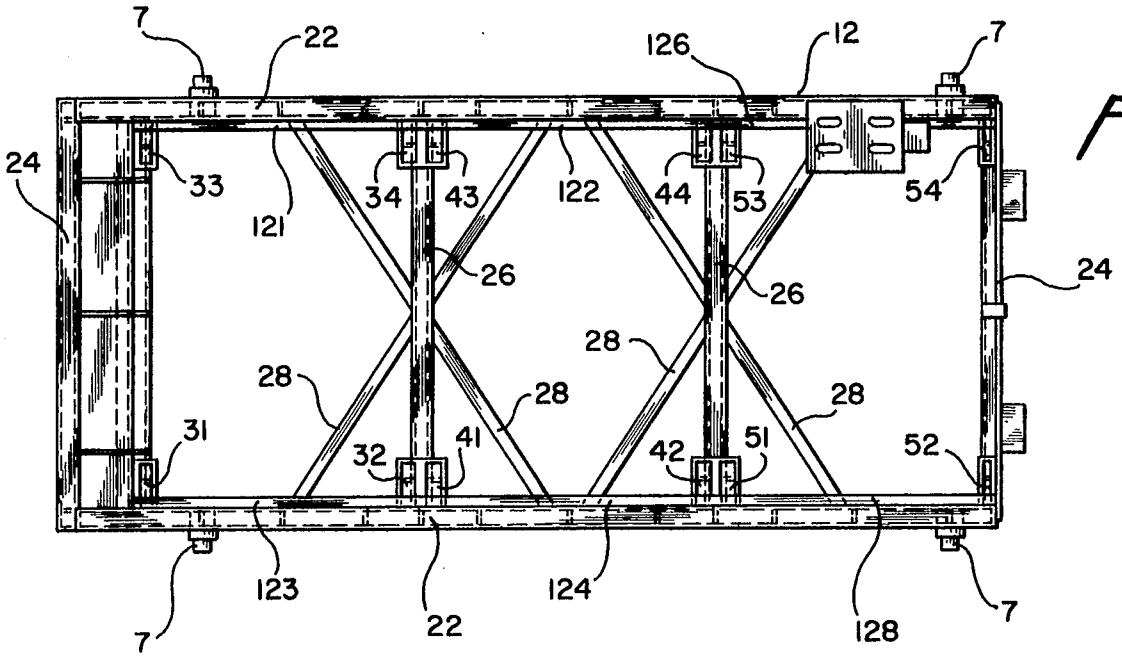
FIG. 3 is a top view of a frame of the shale shaker of FIG. 1.
Figure 5:
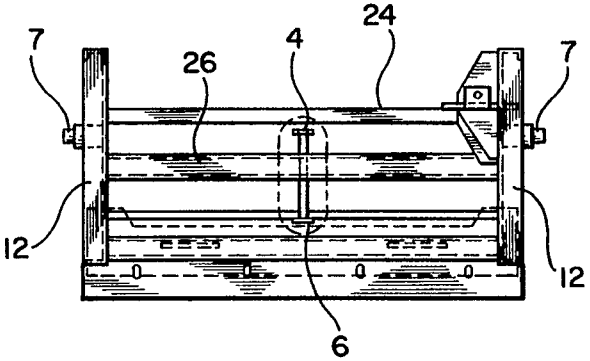
FIG. 5 is an end view of the frame of FIG. 3.
Figure 4:
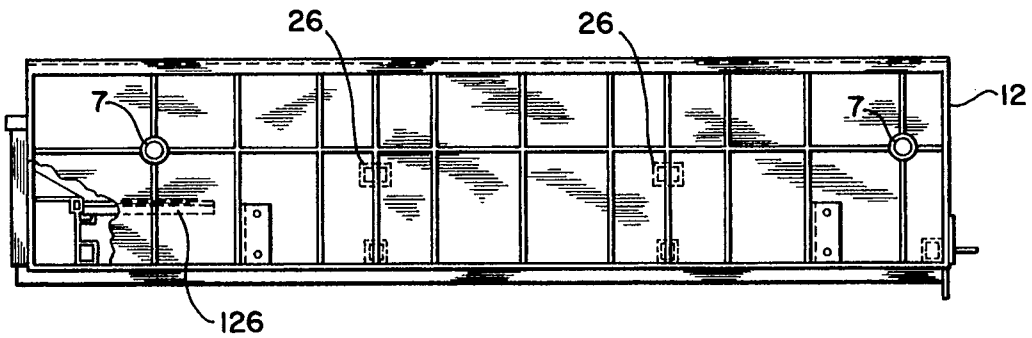
FIG. 4 is a side view of the frame of FIG. 3.

FIG. 3, 4, and 5 illustrate the vibratable screen mounting apparatus 12 and the frame 16. The basket 12 includes side members 22, end members 24, crossbars 26, and cross braces 28 disposed below screens. Mounting bars on the mounting apparatus 12 provide a platform for adjustable supports on which the screens are disposed. The screen 101 is disposed over mounting bars 31, 32, 33, and 34. The screen 102 is disposed over mounting bars 41, 42, 43, and 44. The screen 103 is disposed over mounting bars 51, 52, 53, and 54. Each mounting bar for an adjustable screen mounting device rests on either a frame cross beam 125 or on an upper surface of an angle member 127 which is secured to a cross beam 125 and to the sides 22. A bolt 4 rotatably mounted through the bar 26 with an end block 6 may be used to contact and press downwardly on a screen for stability and to prevent a screen from bowing upward. One such bolt or more may be provided for each screen. Preferably the size of the end blocks 6 is minimized so that a substantially unobstructed uncluttered surface is presented to fluid to be screened. Spring mounts 7 provide for a connection of the springs 14 between the basket 12 and the frame 16.

Each screen is held in opposed side mounting channels. The side mounting channels are secured to the sides 22 of the basket 12. Back-up braces 159 help secure each side mounting channel to the basket. A screen can be inserted into its side mounting channels and removed therefrom independently of the other screens when adjustable mounts for holding the screens are loosened.

Figure 8:
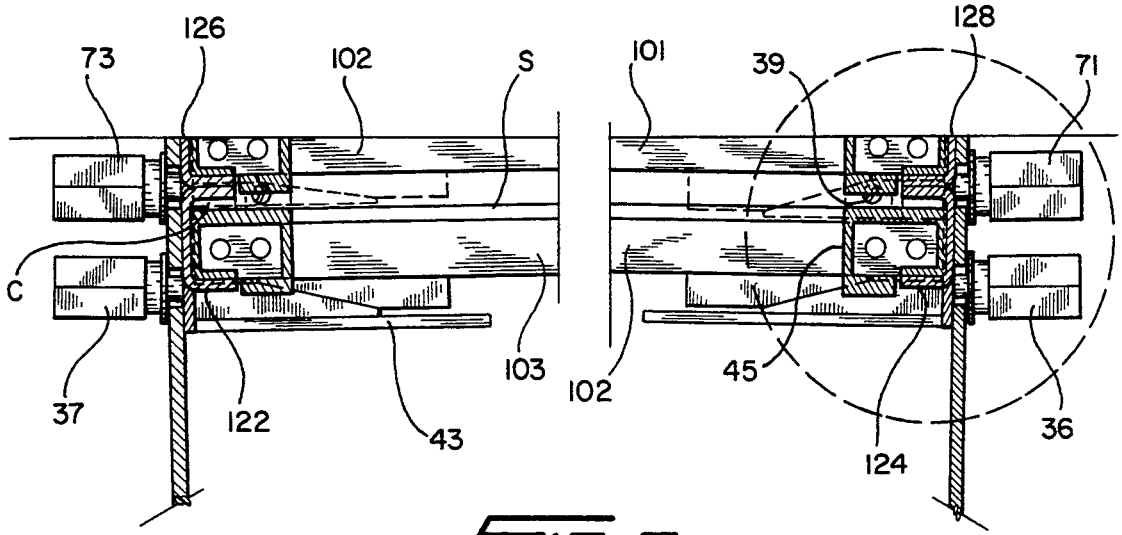
FIG. 8 is an end view of the items of FIG. 6.
Figure 9:
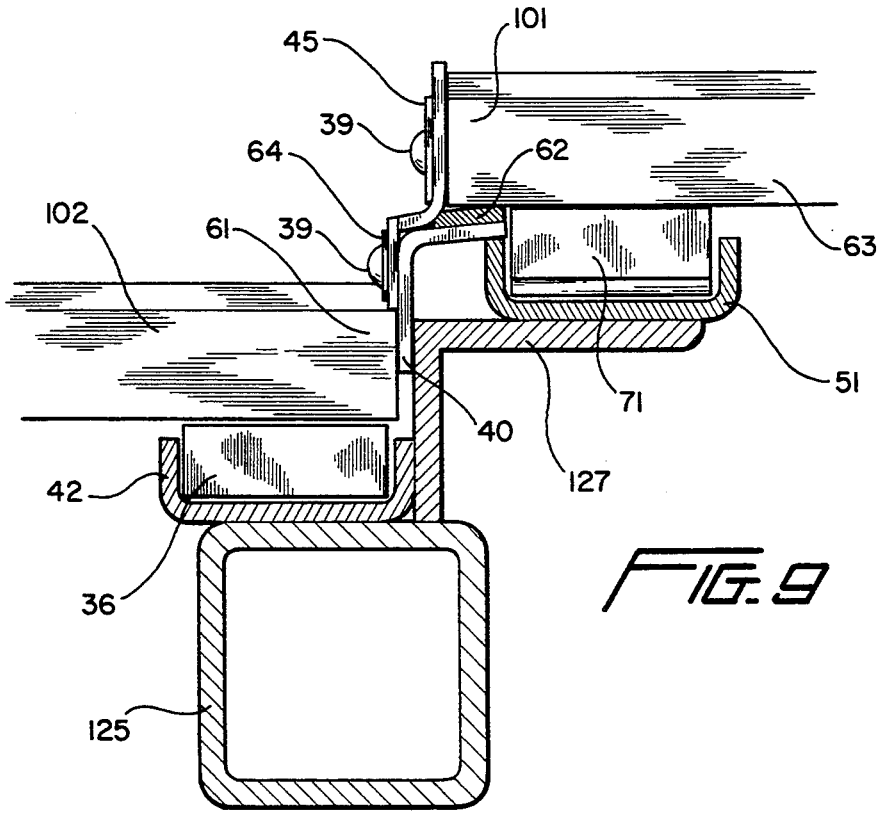
FIG. 9 is an enlarged view of the structure circled in FIG. 7.
Figure 10:
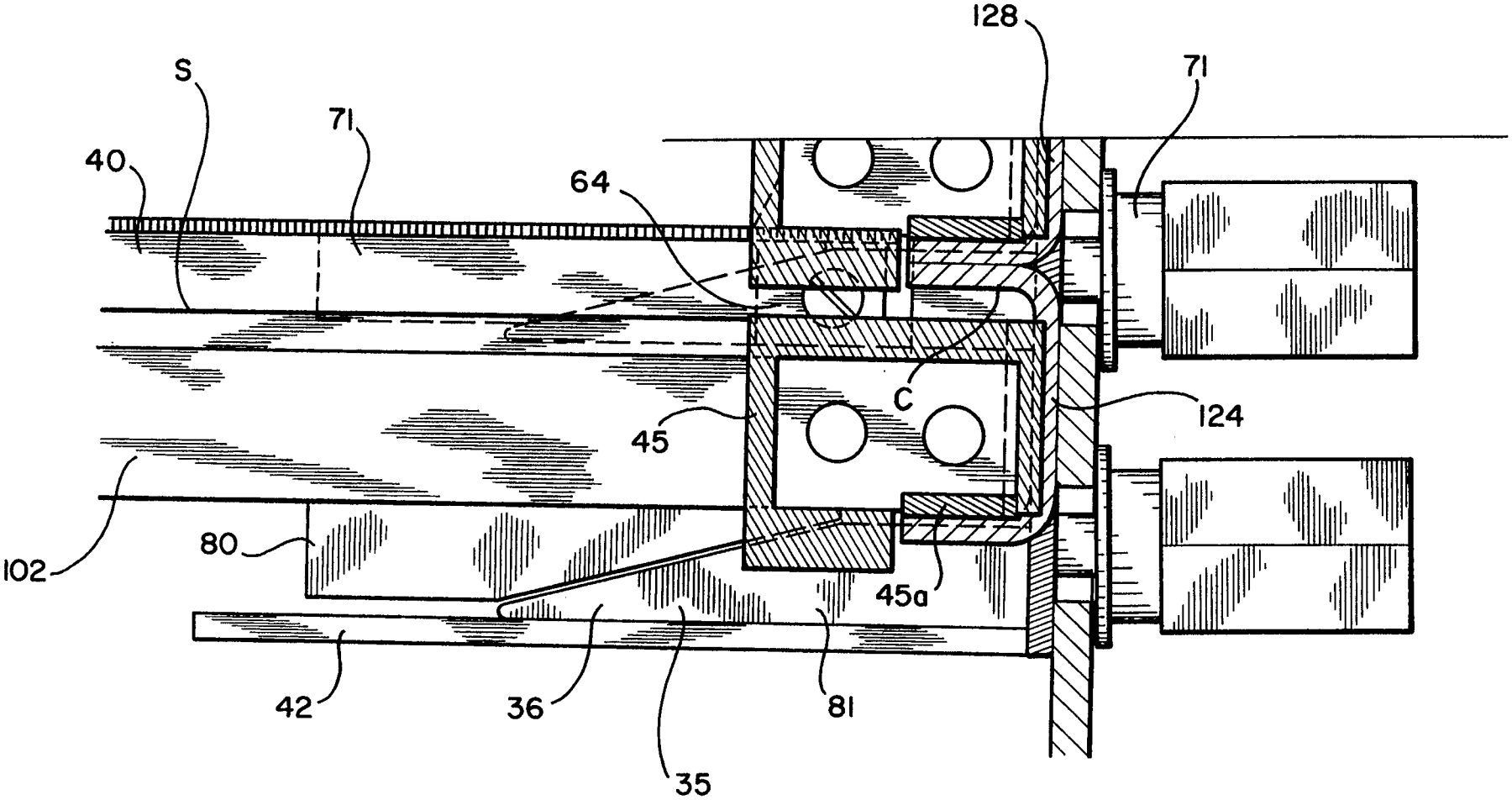
FIG. 10 is an enlarged view of the structure circled in FIG. 8.

FIGS. 8 and 10 illustrate side mounting channels in which the screens 102 and 101 are mounted. The screen 102 is mounted in side mounting channels 122 and 124 and the screen 101 is mounted in side mounting channels 126 and 128.

Figure 17:
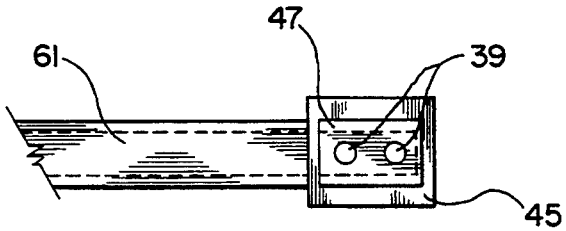
FIG. 17 is an end view of the structure shown in FIG. 16.

FIG. 6, 7, 8 and 9 illustrate the mounting of one of the screens. The screen 102 rests on adjustable mounts 35, 36, 37, and 38 each of which is disposed on a mounting bar 41–44. An angled bar 40 is secured to or formed integrally of an end of a frame 61 of the screen 102. A seal strip 62 (e.g. but not limited to a nitrile strip) is secured to the bar 40 along its length. Preferably the angled bar and seal strip are shorter than the distance between the outer edges of a screen's opposed side mounting channels so that a screen can be inserted into the side mounting channels without the ends of the angled bar having to be inserted therein. This permits the use of angled bars of desired height projecting above the screen. Any minimal space between ends of the angled bar or seal strip and interior edges of side mounting channels is sealed with seal pads as described below. As described in detail below, the adjustable mounts 35 and 36 releasably urge the screen 102, and therefore the seal strip 62, sealingly up against a frame 63 of the screen 101. Screws 39 and a metal washer 47 secure seal pads 64 (e.g. but not limited to a nitrile pad) at opposite sides of one end of the screen 102 to the bar 40 to seal against ends of the mounting channels 122 and 124 and to seal off part of the flow path through the channels. The screen 102 has seal pads 45 secured with screws 39 and a washer 47 at another end on opposite sides of its frame to seal against the other ends of the channels 122 and 124. Similarly the other screens have seal pads secured at opposite sides and at either end of their frames to seal against the channel ends. As shown in FIG. 17 the seal pads 45 extend beyond the edges of the screen as necessary to effectively seal against the channel ends and seal off a possible fluid flow path through the channels. As shown in FIGS. 8 and 10, the adjustable mounts have not been tightened to raise the screen 102 and push it up against the screen 101 and push the screen surface S up against an interior top surface C of the side mount channels. A seal pad 45 seals over a vertical edge of the channel 124 and a portion of the pad 45a is bent against and seals against an inner lower surface of the channel 124. Thus any flow paths between the screen 102 and the channel 124 at this end of the screen are sealed so that fluid may not bypass the screen at these locations. At the other end of the screen 102, a seal pad 64 provides a seal at a space between an end of the bar 40 and an inner edge of the side mount channel 124, thus preventing fluid from bypassing the screen through this space.

Adjustable mount apparatuses 71, 72, 73, 74 (73, 74 not shown, but disposed across from 71, 72) releasably urge the screen 101 sealingly up against mounting channels 126 and 128 on either side of the screen 101. The screen 101 is somewhat loosely disposed in the mounting channels when the adjustable mounts have not yet been manipulated to tighten the screen in place. Thus any individual screen in a tiered screen arrangement can be inserted into or removed from side mounting channels without removing another screen. The screen 101 has an angled bar 67 like the bar 40 at its end under the bar 11. A seal strip 201 on the bar 67 is releasably urged sealingly upwardly against the bar 11 by the adjustable mount apparatuses 72 and 74. Item 157 indicates an optional pneumatically powered apparatus for pulling (or pushing) the bolt of the adjustable mount to pull (or push) the top wedge member with respect to the bottom wedge member. In one embodiment pneumatically movable bolts are used on each of twelve adjustable mount apparatuses. In one such embodiment all of the twelve pneumatically operated devices for moving the bolts are interconnected in one pneumatic system so that activation of one switch moves all of the bolts simultaneously. In this embodiment it is preferred that the bottom wedge member be secured (as by welding) to a mount channel.

The screen 103 is urged sealingly upwardly against the screen 102 and against its side mounting channels 121, 123 by its corresponding adjustable mounts 75, 76 (shown) and, 77, and 78 (disposed opposite the mounts 75, 76,, but not shown). The screen 103 has an angled bar 60 to which is secured a seal strip 70 and which is releasably urged up sealingly against an end of the screen 102 by the adjustable mounts 76 and 78. The adjustable mounts 75 and 77 releasably urge the other end of the screen 103 sealingly up against the side mounting channels 121 and 123. The screen 103 has side seal pads like the pads 45 and 64 for sealing the ends of its corresponding mounting channels. Preferably when tiered screens are employed the angled bar and seal strip or sealing angled bar are sized and disposed so that they extend above the screen on which they are used, projecting upwardly sufficiently to sealingly contact a screen disposed above and adjacent the strip or bar.

Figure 18:
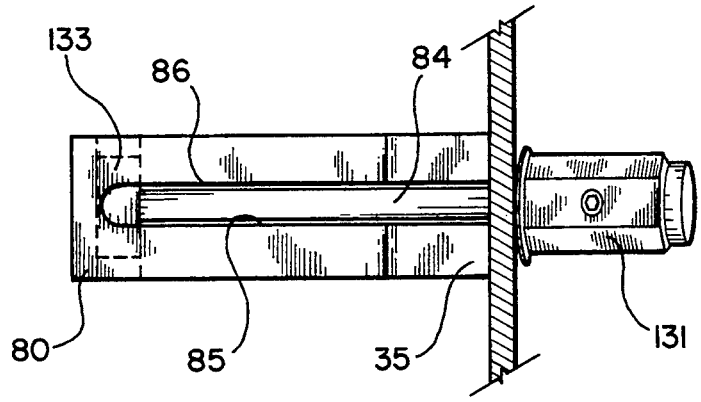
FIG. 18 is a top view of an adjustable mounting device according to the present invention.
Figure 19:
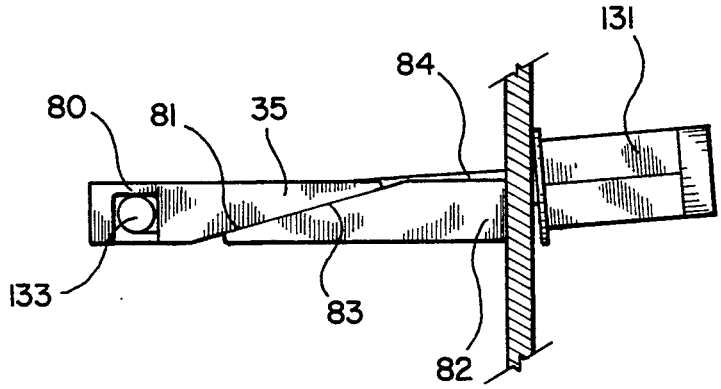
FIG. 19 is a side view of the device of FIG. 18.

FIGS. 18 and 19 show the structure of the adjustable mounts. For illustration and explanation one of the mounts, the mount 35 is shown. The mount 35 has an inner movable wedge member 80 with a lower wedge surface 81 and an outer movable wedge member 82 with an upper wedge surface 83. A bolt 84 extends through a channel 85 in the wedge member 82 and an open trough 86 in the wedge member 80 which is open to the top of the wedge member. The bolt 84 is disposed through a hole in the side of the mounting apparatus 12 and has a "T" end 133 movably disposed in a channel 134 in the wedge member 80. Rotation of a threaded nut 131 engages threads on the bolt 84 causing the wedge member 80 to move with respect to the wedge member 82. As the nut 131 is tightened, the wedge surface 83 forces the wedge member 81 up against the bottom of the frame of the screen 102, thereby forcing the screen 102 sealingly upwardly against the screen 101. Loosening of the nut 131 causes the wedge member 80 to move away from the wedge member 82 with the wedge surface 81 moving down on the wedge surface 83, thus reducing the upward force on the screen 102 and, eventually returning it to a loose (and removable) disposition in the side mounting channels. A cap 132 on the bolt 84 prevents the nut 131 from falling off and provides a maximum limit for travel of the nut 131 outwardly (i.e. a maximum looseness for the adjustable mount and a corresponding maximum degree of freedom for the screen within the side mounting channels). The bolt is movable vertically with respect to the trough as the bolt T end 133 rotates in the channel 134.

Figure 11:
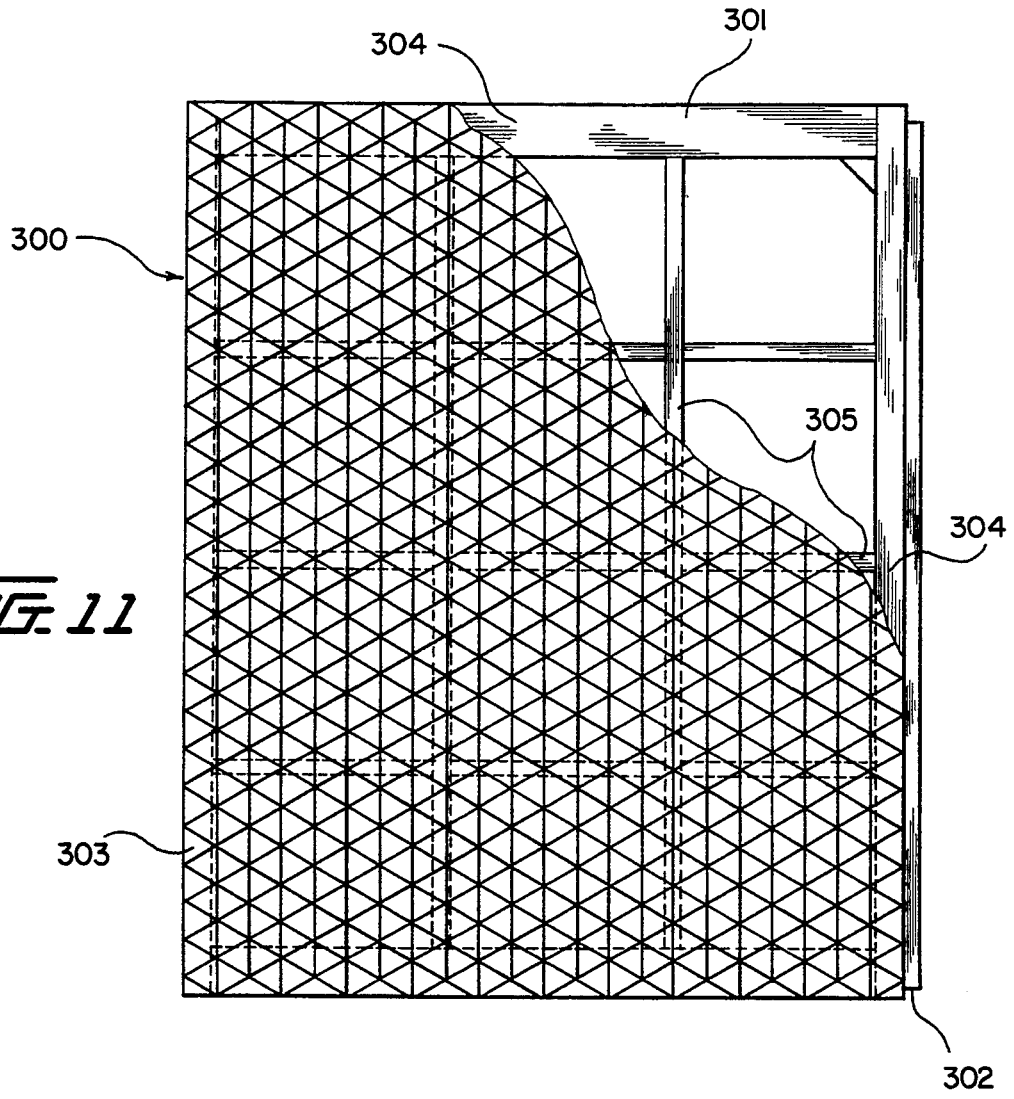
FIG. 11 is a top view, partially cut-away, of a screen according to this invention.
Figure 12:
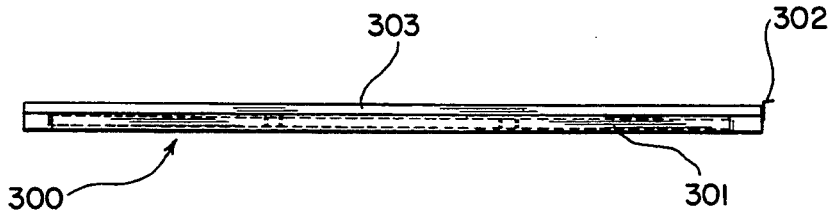
FIG. 12 is a side view of the screen of FIG. 11.
Figure 13:
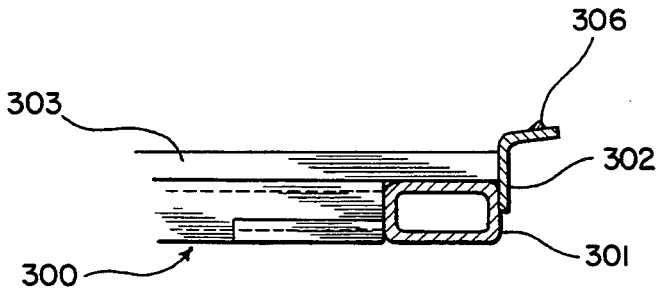
FIG. 13 is a side view in cross section of the screen of FIG. 11.
Figure 14:
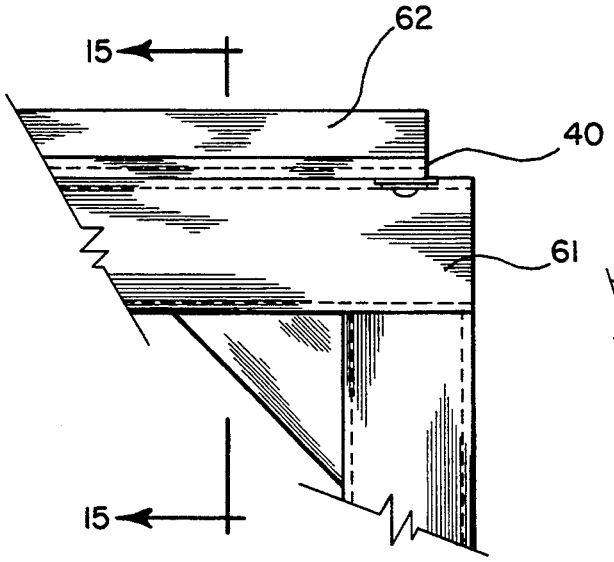
FIG. 14 is a partial top view of part of the screen shown in FIG. 6.
Figure 15:
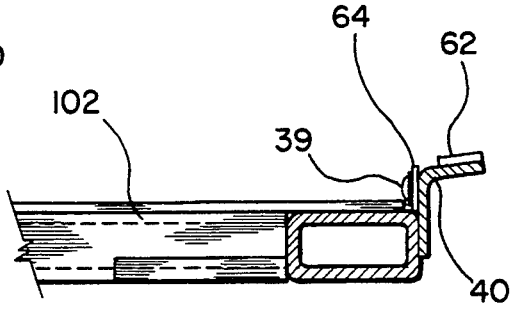
FIG. 15 is a partial side view in cross section along line 15—15 of the screen of FIG. 14.
Figure 16:
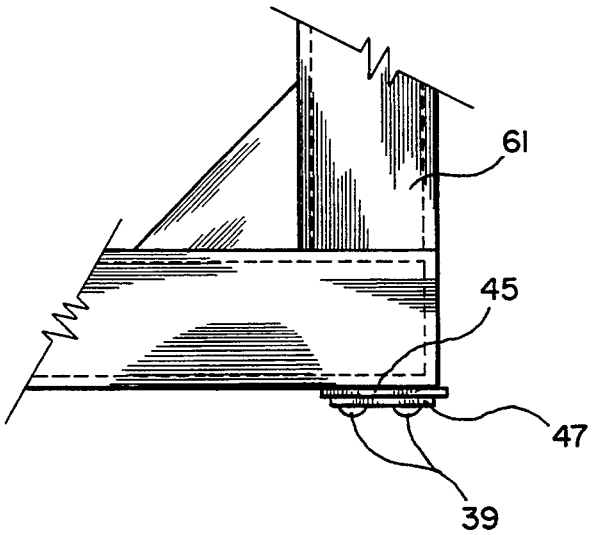
FIG. 16 is a partial top view of another end of the screen of FIG. 14.

FIG. 11, 12 and 13 illustrate a screen 300 according to the present invention with lower screen support frame 301 including outer frame members 304 and cross braces 305 to which is secured an end seal strip 302 (like the previously described seal strips 42 and 68) but with a top sealing bead 306. A screen 303 (e.g. but not limited to a screen as disclosed in pending U.S. application Ser. No. 08/056,123 filed on Apr. 30, 1993 or as in pending U.S. application Ser. No. 08/045,489 filed on Apr. 8, 1993) is secured on the frame 301.

Figure 20:
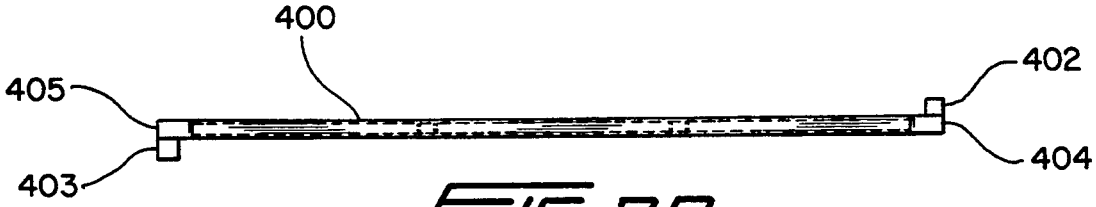
FIG. 20 is a side view of a screen according to the present invention.

FIGS. 20, 21, 22, and 23 illustrate various rectangular screens according to the present invention. A screen 400 shown in FIG. 20 is like the previously described screens; but instead of a seal strip connected to a bar secured to a screen frame, the screen 400 has block seal strips 402, 403 secured to end channels 404 and 405. Such a screen could serve as a middle screen in a tiered screen arrangement with the block seal strip 402 sealing the interface with an upper screen and the block seal strip 403 sealing the interface with a lower screen.

Figure 21:
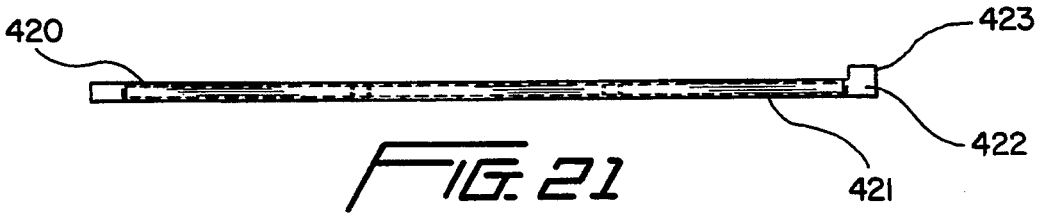
FIG. 21 is a side view of a screen according to the present invention.

A screen 420 shown in FIG. 21 has a frame 421 and an end channel 422 made of suitable sealing material with an upper portion 423 for sealing against a screen with an end disposed above the screen 420. Alternatively, the screen 420 could be flipped over so that the portion 423 seals against an end of a screen disposed below the screen 420. In one aspect a screen with a seal portion at either end provides end-to-end sealing of non-tiered screens.

Figure 6:
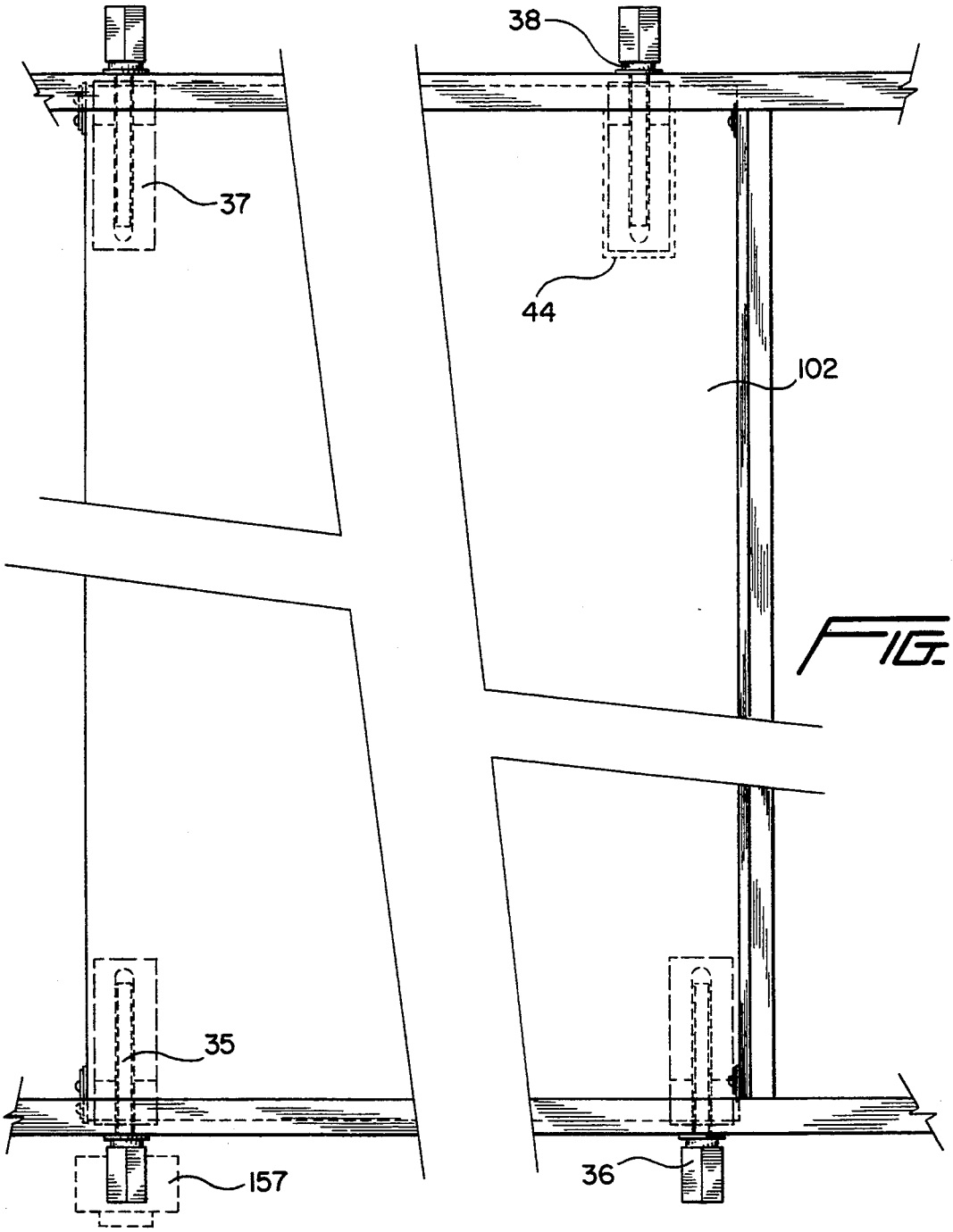
FIG. 6 is a top view of a screen and screen mounting devices of the shaker of FIG. 1.
Figure 7:
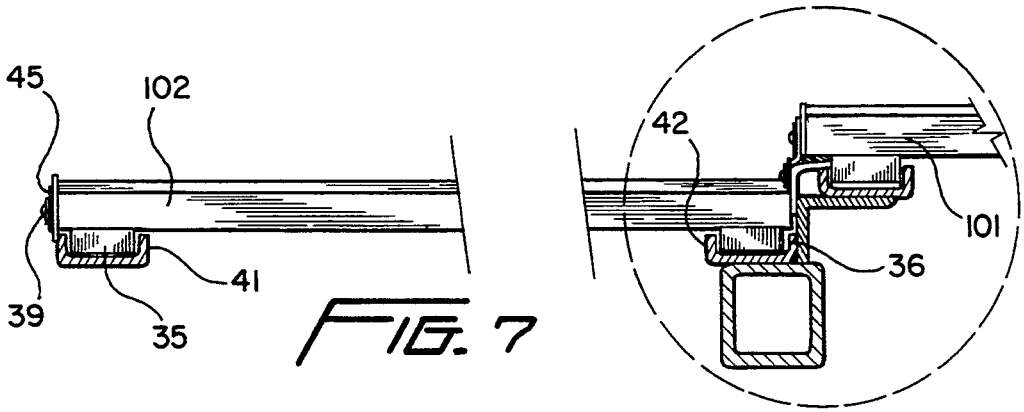
FIG. 7 is a side view in cross-section of the items of FIG. 6.
Figure 22:
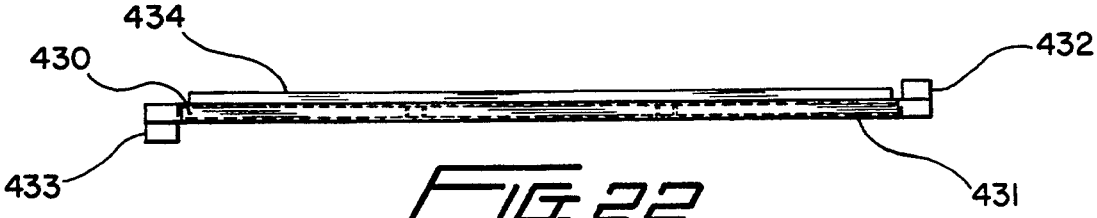
FIG. 22 is a side view of a screen according to the present invention.

FIG. 22 illustrates a rectangular screen 430 like the screens in FIGS. 6 and 11 but without seal strips secured to angled bars. Instead the screen 430 has block seal strips 432 and 433 secured to its frame 431 for sealing against tiered screens at either of its ends. Also side seal strips 434 (one shown) are secured along the sides of the screen 430 to press sealingly against a top interior surface of a screen side mounting channel on the frame of a shale shaker or other device. The side seal strips 434 could, alternatively, be formed integrally of the screen frame.

Figure 23:
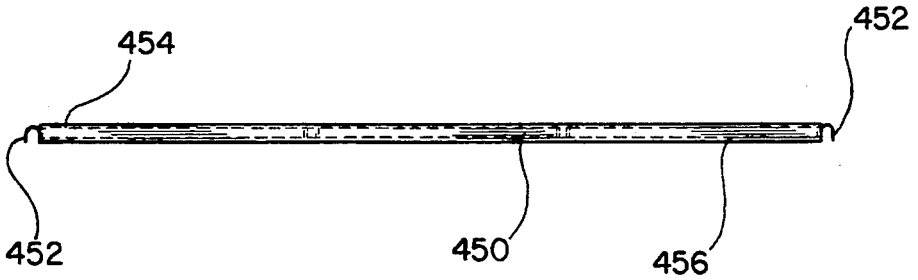
FIG. 23 is a side view of a screen according to the present invention.

A screen 450 shown in FIG. 23 has flexible seal strips 452 releasably secured along the length of either or both ends 454 and 456. These seal strips provide sealing for the screen 450 against adjacent screen ends in an end-to-end (i.e. non-tiered) multiple screen configuration or against bars or other members adjacent a screen end.

Figure 24:
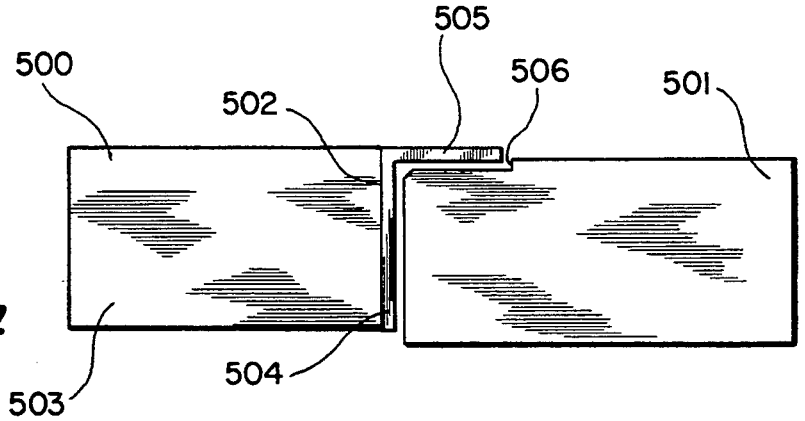
FIG. 24 is a side view of a screen according to the present invention.

FIG. 24 illustrates rectangular screens 500 and 501 according to the present invention. Screen 500 is similar to the screen 300 and 102 previously described herein; but an angled bar 502 secured to a frame 503 of the screen 500 has a side portion 504 at a right angle to a top seal portion 505. The top seal portion 505 and the angled bar 502 extend from side to side of that end of the screen. A recess 506 of the screen 501 receives the top seal portion 505. Upward force on the screen 501 (as applied by the adjustable mounts previously described) urges the end of the screen 501 with the recess 506 sealingly against the end of the screen 500 and its top seal portion 505 for sealing end-to-end screen contact in which a relatively flat surface is presented to fluids flowing from the screen 501, over the seal portion 505, and over the screen 500. Of course the screen 501 may have an angled bar 502 secured at its end opposite the end with the recess 506 if desired and the screen 500 can have a recess 506 at its end opposite the end with the angled bar 502 if desired.

Figure 25:
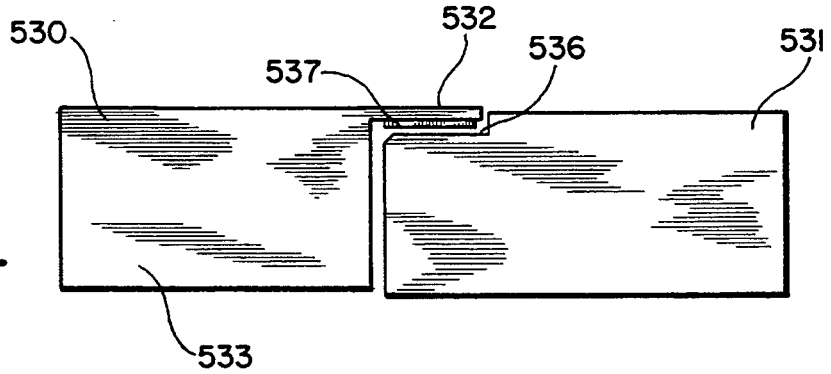
FIG. 25 is a side view of a screen according to the present invention.

FIG. 25 illustrates rectangular screens 530 and 531 according to the present invention. The screen 530 is similar to the previously described screens 300 and 102; but a frame 533 of the screen 530 includes an extending top seal portion 532 with a lower seal strip 537 secured to an underside 539 thereof. The screen 531 has a recess 536 which receives the top seal portion 532 and the lower seal strip 537. The top seal portion 532 and the lower seal strip 537 extend from one side of the screen to the other at that end of the screen. An upward force on the screen 531 urges its end with the recess 536 up against the lower seal strip 537 along the end of the screen 530 for sealing end-to-end screen contact. The screen 530 may be provided with a recess 536 at its end opposite the end with the seal strip 537 and the screen 531 may be provided with an extending top seal portion 532 at its end opposite the end with the recess 536. Preferably in certain embodiments the screen surfaces are flat including the portion-532-top-of-screen-531 interface.

Figure 26:
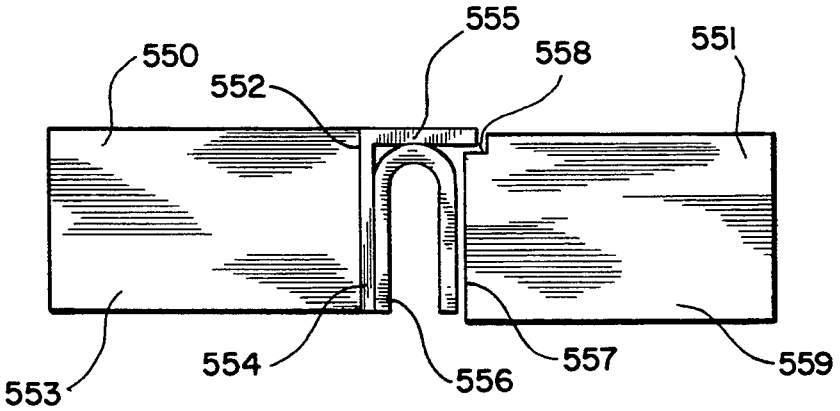
FIG. 26 is a side view of a screen according to the present invention.

FIG. 26 illustrates rectangular screens 550 and 551 according to the present invention. The screens 550 and 551 are like the screens previously described herein; but the screen 551 has an angled member 552 secured to a frame 553 at one of its ends and extending from one side of the screen to the other at that end. A flexible seal member 556 is secured to a side portion 554 of the angled bar 552. A top seal portion 555 of the angled bar 552 extends beyond the screen end. An end recess 558 in a frame 559 of the screen 551 extends from one side of the screen 551 to the other for co-acting with the top seal portion 555 of the angled bar 552 of the screen 550. Upward urging of the screen 551 urges the recess 558 sealingly against the top seal portion 555 for sealing end-to-end contact of the screens 550 and 551. An end 557 of the frame 559 sealingly abuts the flexible seal member 556. Preferably the screen surfaces are flat in certain embodiments including the top seal portion 555 so that the portion-555-screen-551 interface is flat.

The screens in FIGS. 20–26 are shown somewhat schematically and it is to be understood that each of them may include: a frame of multiple members such as end and interconnected side members; one or more screen cloths covering a frame; and/or one or more cloth support structures or grids—all such as but not limited to the items referred to or described in the text hereof.

In conclusion, therefore, it is seen that the present invention and the embodiments disclosed herein and those covered by the appended claims are well adapted to carry out the objectives and obtain the ends set forth. Certain changes can be made in the subject matter described, shown and claimed without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. An adjustable shale shaker screen support for sealingly forcing a screen against another member, the support comprising a first wedge member having a top surface, a lower inclined surface and an open trough therein open to the top of the first wedge member, a second wedge member having a bottom surface and having an upper inclined surface corresponding to and for co-action with the lower inclined surface of the first wedge member, a bolt extending on one side from the second wedge member and on the other side into the open trough of the first wedge member, the bolt having a bolt body and a bolt end at an angle to the bolt body, the bolt end movably disposed in and held in a bolt end channel in the first wedge member, a nut threadedly engaging the bolt and rotatable on the bolt, and rotation of the nut effecting movement of the lower inclined surface of the first wedge member on and with respect to the upper inclined surface of the second wedge member thereby changing the distance between the top surface of the first wedge member and the bottom surface of the second wedge member, the bolt movable vertically with respect to the open trough as the bolt end rotates in the bolt end channel.

2. The support of claim 1 wherein the nut is manually rotatable.

3. The support of claim 2 comprising also pneumatically-powered bolt movement means interconnected with the bolt for movement thereof to operate the screen support.

4. A shale shaker comprising a base, a vibratable shaker basket for holding at least one shaker screen, the shaker basket mounted movably with respect to and on the base, means for vibrating the vibratable shaker basket, at least one screen releasably mounted on the shaker basket, the at least one screen comprising a screen frame, screening material attached to and covering the screen frame, at least one sealing element secured to an end of the screen frame for sealingly contacting another screen in the shale shaker or for sealingly contacting an end portion of the shaker basket, the at least one sealing element comprising a seal strip secured to and extending along an end of the screen frame and disposed for sealingly contacting an end of a second screen positioned adjacent the first screen, at least one side sealing member for sealing against a portion of a mount apparatus in which the screen is mounted, the at least one screen comprising three screens disposed end-on-end one next to the other, each screen held in sealing contact with each adjacent screen by shaker screen support means for supporting each screen, and each screen held in sealing contact with screen mounting apparatus in which each screen is mounted, the three screens mounted in tiered fashion with a first highest screen sealingly contacting a second middle screen, the second middle screen positioned at a level below a level of the first highest screen, the second middle screen sealingly contacting a third lowest screen, the second middle screen positioned at a level above a level of the third lowest screens, the screens disposed in end-to-end alignment for the movement of material to be screened initially to the first highest screen, from thence to the second middle screen, and from thence to the third lowest screen, the screen mounting apparatus having a pair of side mount channels for each screen, the side mount channels at different levels corresponding to levels of the screens, each screen having side sealing members for sealing against ends of the side mount channels, and the shaker screen support means including a plurality of adjustable screen supports for each screen.

5. The shale shaker of claim 4 comprising also each screen having side frame members corresponding to sides of the side mount channels, and a seal strip secured to a top of each side frame member for sealingly contacting an interior surface of a corresponding side mount channel.

6. A shale shaker comprising a base, a vibratable shaker basket for holding at least one shaker screen, the shaker basket mounted movably with respect to and on the base, means for vibrating the vibratable shaker basket, said means interconnected with the vibratable shaker basket, at least one screen releasably mounted on the shaker basket, the at least one screen comprising a screen frame, screening material attached to and covering the screen frame, at least one sealing element secured to an end of the screen frame for sealingly contacting another screen in the shale shaker or for sealingly contacting a portion of the shaker basket, the at least one sealing element comprising a seal strip releasably secured to and extending along an end of the screen frame and disposed for sealingly contacting an end of a second screen positioned adjacent the first screen, and the at least one screen comprising three screens disposed end-on-end one next to the other, each screen held in sealing contact with each adjacent screen by shaker screen support means for supporting each screen, and each screen in sealing contact with screen mounting apparatus in which each screen is mounted.

7. The shale shaker of claim 6 wherein the three screens are mounted in tiered fashion with a first highest screen sealingly contacting a second middle screen, the second middle screen positioned at a level below a level of the first highest screen, the second middle screen sealingly contacting a third lowest screen, the second middle screen positioned at a level above a level of the third lowest screens, the screens disposed in end-to-end alignment for the movement of material to be screened initially moving to the first highest screen, from thence to the second middle screen, and from thence to the third lowest screen.

8. The shale shaker of claim 7 wherein the screen mounting apparatus has a pair of side mount channels for each screen, the side mount channels at different levels corresponding to levels of the screens, and each screen has side sealing members for sealing against ends of the side mount channels.

9. The shale shaker of claim 8 wherein the shaker screen support means includes a plurality of adjustable screen supports for each screen.

10. The shale shaker of claim 9 wherein each adjustable screen support comprises a first wedge member having a top surface, a lower inclined surface and an open trough therein open to the top of the first wedge member, a second wedge member having a bottom surface and having an upper inclined surface corresponding to and for co-action with the lower inclined surface of the first wedge member, a bolt extending on one side from the second wedge member and on the other side into the open trough of the first wedge member, the bolt having a bolt end movably disposed in and held in a bolt end channel in the first wedge member, a nut threadedly engaging the bolt and rotatable on the bolt, and rotation of the nut effecting movement of the lower inclined surface of the first wedge member on and with respect to the upper inclined surface of the second wedge member thereby changing the distance between the top surface of the first wedge member and the bottom surface of the second wedge member, the bolt movable vertically with respect to the open trough as the bolt end rotates in the bolt end channel.

11. The shale shaker of claim 8 comprising also each screen having side frame members corresponding to sides of the side mount channels, and a seal strip secured to a top of each side frame member for sealingly contacting an interior surface of a corresponding side mount channel.

* * * * *